US006029814A

United States Patent [19]

Ohuchi

[11] Patent Number: 6,029,814

[45] Date of Patent: Feb. 29, 2000

[54] BLIND RIVET HOLDER

[75] Inventor: Masatoshi Ohuchi, Koriyama, Japan

[73] Assignee: OPT Engineering Company Limited, Fukushima-Ken, Japan

[21] Appl. No.: 09/315,609

[22] Filed: May 20, 1999

[30] Foreign Application Priority Data

May 26, 1998 [JP] Japan ..... 10-144016

[51] Int. Cl.[7] ..... F16B 15/08; B65D 85/24; B65D 85/28

[52] U.S. Cl. ..... 206/347; 206/345; 206/338; 206/382; 206/485; 206/716; 411/442; 411/443

[58] Field of Search ..... 206/343, 345, 206/347, 338, 380, 382, 485, 342, 713, 716; 411/442, 443

[56] References Cited

U.S. PATENT DOCUMENTS

| | | | |
|---|---|---|---|
| 3,438,487 | 4/1969 | Gallee et al. | 206/347 |
| 3,885,669 | 5/1975 | Potucek | 206/338 |
| 4,383,608 | 5/1983 | Potucek | 206/347 |
| 4,606,455 | 8/1986 | Grikis et al. | 206/347 |
| 4,684,022 | 8/1987 | Potucek | 206/347 |
| 4,932,821 | 6/1990 | Steffen et al. | 206/347 |
| 5,090,607 | 2/1992 | Ohuchi et al. | 206/345 |
| 5,096,061 | 3/1992 | Wakai | 206/347 |
| 5,452,796 | 9/1995 | Ohuchi | 206/347 |
| 5,836,732 | 11/1998 | Gupta et al. | 206/347 |
| 5,931,622 | 8/1999 | Gupta et al. | 206/345 |

FOREIGN PATENT DOCUMENTS

| | | | |
|---|---|---|---|
| 2512131 | 11/1975 | Germany | 206/347 |
| 7-236936 | 9/1995 | Japan . | |
| 3028739 | 6/1996 | Japan . | |
| 1255618 | 12/1971 | United Kingdom | 206/343 |
| 2271547 | 4/1994 | United Kingdom | 206/485 |

*Primary Examiner*—Paul T. Sewell
*Assistant Examiner*—Anthony Stashick
*Attorney, Agent, or Firm*—McGlew and Tuttle, P.C.

[57] ABSTRACT

Since a distance of adjacent rivets held by a conventional blind rivet holder was large, a blind rivet holder which is smaller in the rivet distance, and which can accommodate a larger number of rivets in an accommodation case of a continuous riveter is provided. The blind rivet holder is designed to include: upper and lower tabs T4, T5 which are continuously arranged at minute constant intervals with narrow slits T3 formed at upper and lower ends of a perpendicular portion T2 having feeder slots for the blind rivet holder T; through hole s T41 and T51 provided so that a rivet R can be passed through the through hole s obliquely; and an oblique, U-shaped groove T21 provided so as to connect the slit T3 between the adjacent upper tabs T4 to the slits T3 between the adjacent lower tabs T5 and to permit bending from groove as a border.

3 Claims, 6 Drawing Sheets

(a)

(b)

BLIND RIVET HOLDER

BACKGROUND OF THE INVENTION

1. Field of the Invention

The present invention relates to a blind rivet holder adapted for use with a riveter that can consecutively eject blind rivets.

2. Description of the Related Art

A conventional blind rivet holder disclosed in Japanese Utility Model Registration No. 3028739 (Title: Blind Rivet Holder) is constructed as shown in FIGS. 7 to 9.

The holder shown in FIGS. 7 to 9 is adapted for use with a continuous riveter (disclosed in Japanese Patent Application Laid-open No. Hei 7-236936) in FIG. 6, and designed to support a rivet R in a rearwardly oblique manner with an upper tab T4 and a lower tab T5. In contrast to a conventional design in which a rivet R is disposed perpendicularly with respect to a longitudinal direction, the blind rivet holder T1 makes it possible to perform the rivet ejection easily with the rear portion of the continuous riveter being held upwardly.

Although not shown in the drawings, the continuous riveter used in combination with the blind rivet holder T1 is constructed such that an axis of a portion for holding the rivet R in a continuous riveter shown in FIG. 6 (for instance, a chuck cylinder 10) is inclined rearwardly with respect to a guide plate 43.

The blind rivet holder T1 shown in FIG. 6 has a perpendicular portion T2, the upper tab T4 and the lower tab T5 so that it can be fed along a U-shaped guide plate 43.

In FIG. 6, a jaw case piston 20 is raised to move a jaw case 22 upwardly, thereby moving a rod R1 of the rivet R held by a jaw 24 upwardly. That is, FIG. 6 shows a state in which a metal plate H is caulked by a rod portion R2 of the rivet main body. Concurrently, the lower end of the rod R1 is cut by a tensile force, and removed (although not shown in the drawings). In FIG. 6, a reference numeral 11 designates a vacuum ejector, a reference numeral 14 designates a rod collecting case, a reference numeral 30 designates a nose piston, a reference numeral 32 designates a nose piece, and a reference character C designates a rivet supply section.

Each of the blind rivet holders T1 shown in FIGS. 7 to 9 and FIG. 6 is not bendable, i.e. in the form of a fixed linear shape, so that a rivet distance between adjacent rivets R in the blind rivet holder must be set so as not to hinder the lowering movement of a cylinder 31 (FIG. 6). Therefore, a large number of the rivets R cannot be accommodated in an accommodation case 40.

SUMMARY OF THE INVENTION

The present invention was made in view of the above-noted problem, and an object of the present invention is to provide a blind rivet holder in which the rivet distance can be set smaller, thereby making it possible to accommodate a larger number of rivets R even in a small accommodation case.

To attain the above-mentioned object of the present invention, there is provided a blind rivet holder including:

a U-shaped elongated member having upper and lower tabs that are continuously arranged at minute constant intervals with narrow slits formed in upper and lower ends of a perpendicular portion;

feeder slots, formed in the perpendicular portion, for feeding the elongated member in a specified direction;

a first through hole, formed in each of the upper tabs, for holding a rod of a blind rivet passed therethrough; and a second through hole, formed in each of the lower tabs, for holding a rod portion of a rivet main body passed therethrough so that a head of the rivet main body of the blind rivet is retained on an inner side of the lower tab.

The blind rivet holder according to the present invention is further characterized in that:

the upper and lower tabs are offset in position from each other horizontally in a longitudinal direction of the perpendicular portion;

the first and second through hole s are inclined at an angle to conform with the rod and rod portion of the blind rivet passed obliquely; and an inclined, recessed groove is provided on an inner side of the perpendicular section so as to connect the slit between the adjacent upper tabs to the slits between the adjacent lower tabs.

In the blind rivet holder, it is preferable that the elongated member is relatively rigid but bendable at locations where the recessed groove is provided.

In the blind rivet holder, it is preferable that a first slit between adjacent upper tabs, a second slit between adjacent lower tabs, and a recessed groove connecting the first slit to the second slit cooperatively facilitate the bending of the elongated member to increase a distance between adjacent first through hole s provided in the adjacent upper tabs and a distance between adjacent second through hole s provided in the adjacent lower tabs.

DETAILED DESCRIPTION OF THE PREFERRED EMBODIMENT

An embodiment of the present invention will be described with reference to the drawings attached hereto.

Figure 1:
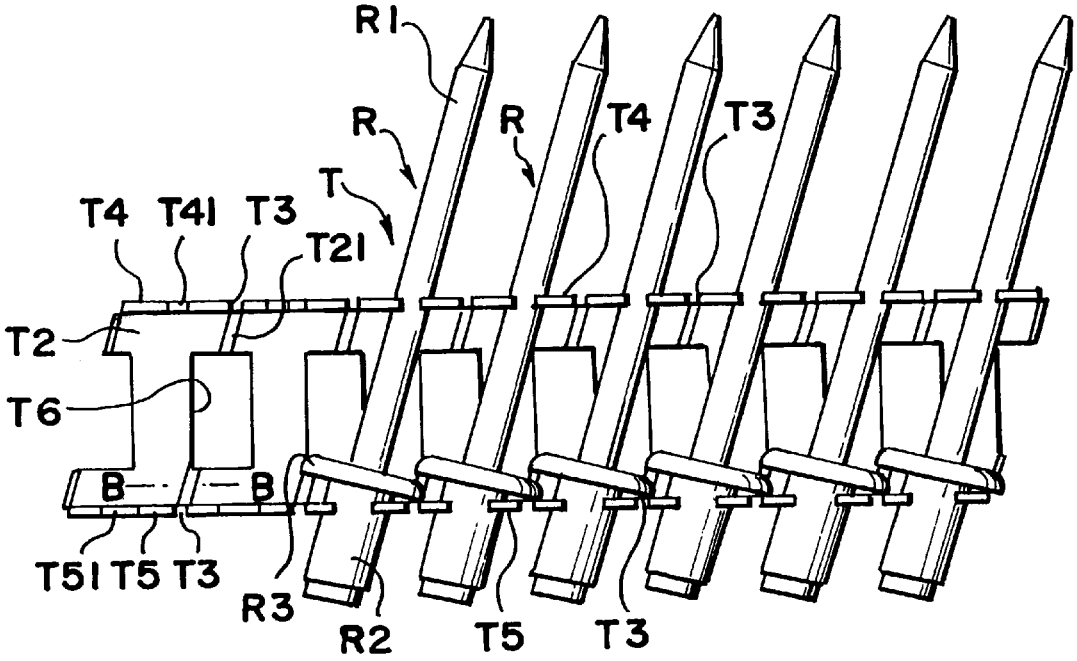
FIG. 1(*a*) is a front view showing an embodiment of the present invention, and FIG. 1(*b*) is a cross-sectional view showing a recessed groove.
Figure 1:
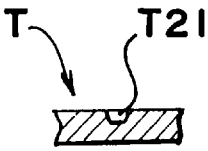
Figure 2:
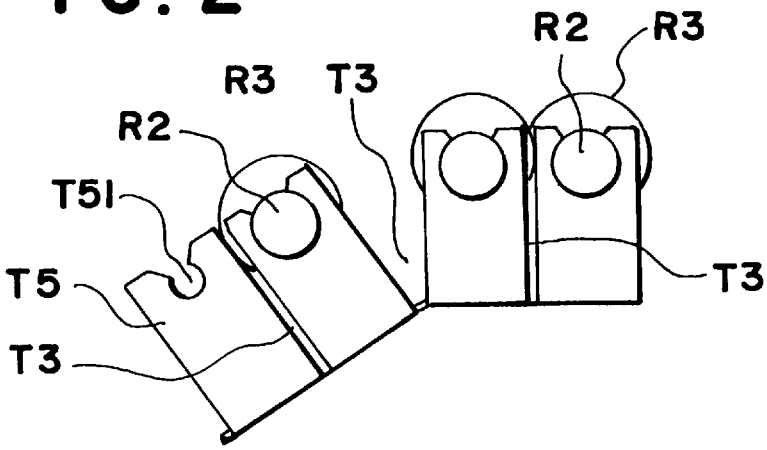
FIG. 2 is a bottom view showing a state in which the embodiment of the present invention is bent.

FIGS. 1(*a*) is a front view of a blind rivet holder in a state in which blind rivets are mounted thereto, and FIG. 2 is a bottom view of the blind rivet holder in a state in which the blind rivet holder is bent, both showing the embodiment of the present invention.

The blind rivet holder according to the present invention is a U-shaped elongated member which has perpendicular sections T2 and upper and lower tabs T4 and T5 that are provided on upper and lower end edges of the perpendicular sections T2 and that are continuously arranged at minute constant pitches through narrow slits T3. The upper and lower tabs T4 and T5 are offset from each other horizontally in a longitudinal direction of the perpendicular sections T2.

Figure 3:
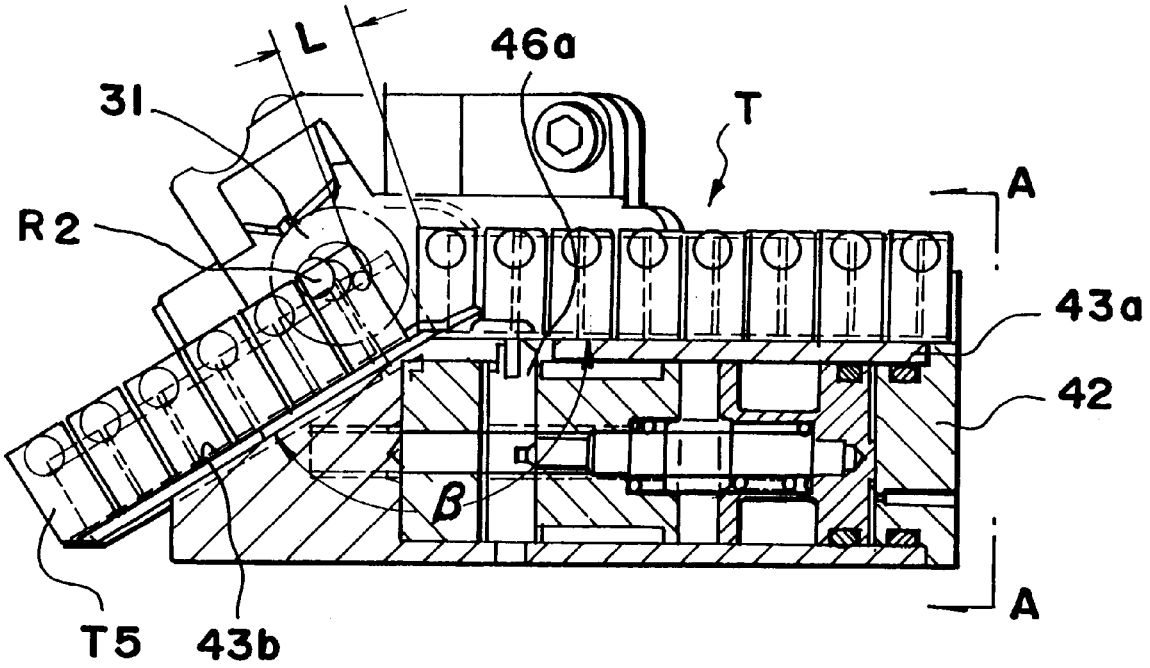
FIG. 3 is a bottom view showing a state in which a blind rivet holder according to the present invention is used in combination with a continuous riveter.

The perpendicular sections T2 are provided with feeder slots T6 for feeding the entire elongated member T1 in a specified direction, so that with a feed claw 46*a* of a tape air cylinder 42 as shown in FIG. 3, the rivets supported by the elongated member T1 are fed along a linear feed section 43*a* of a guide plate to a bent section 43*b* one by one.

Figure 4:
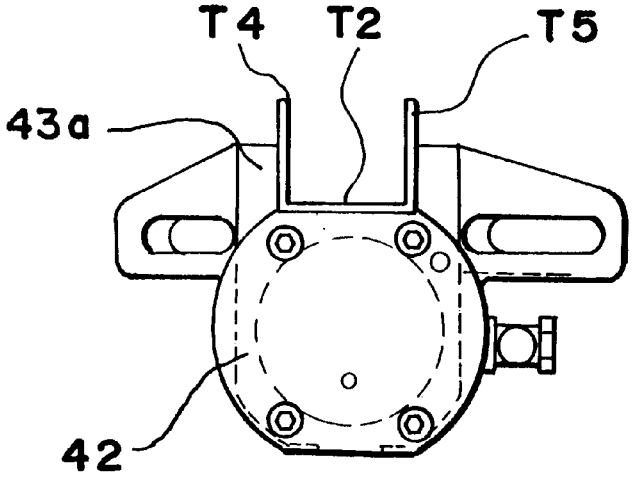
FIG. 4 shows the embodiment as viewed in an arrow A-A direction in FIG. 3.

FIG. 3 is a bottom view of a continuous riveter with which the blind rivet holder according to the present invention is used, and FIG. 4 shows the continuous riveter as viewed along a direction indicated by an arrow A—A of FIG. 3, which illustrates how the blind rivet holder T is used.

As shown in FIG. 1, the upper tab T4 is formed with a first through hole T41 for holding a rod R1 of a rivet R inserted thereinto, and the lower tab T5 is formed with a second through hole T51 for holding a rod portion R2 of the rivet main body with the rod portion R2 inserted thereinto in a state where a head portion R3 of the rivet main body is retained on the inner side of the lower tab. Each of the first through hole T41 and the second through hole T51 has a peripheral surface that is inclined with respect to the alignment direction so as to contact the outer periphery of the rivet R.

The first through hole T41 and the second through hole T51 are formed in a bow so as to permit the removal of the rod Rl of the rivet R and the rod portion R2 of the rivet main body, respectively.

The perpendicular section T2 is provided at its inner surface side with an inclined, recessed groove T21 connecting the slit T3 between the adjacent upper tabs T4 to the slit T4 between the adjacent lower tabs T5. The blind rivet holder T can be bent at an angle β with the aid of this recessed groove T21 when it extends across the linear feed section 43*a* and bent section 43*b* of the guide plate as shown in FIG. 3. FIG. 2 shows the blind rivet holder T thus bent.

FIG. 1(*b*) is a cross-sectional view showing the recessed groove T21.

Figure 5:
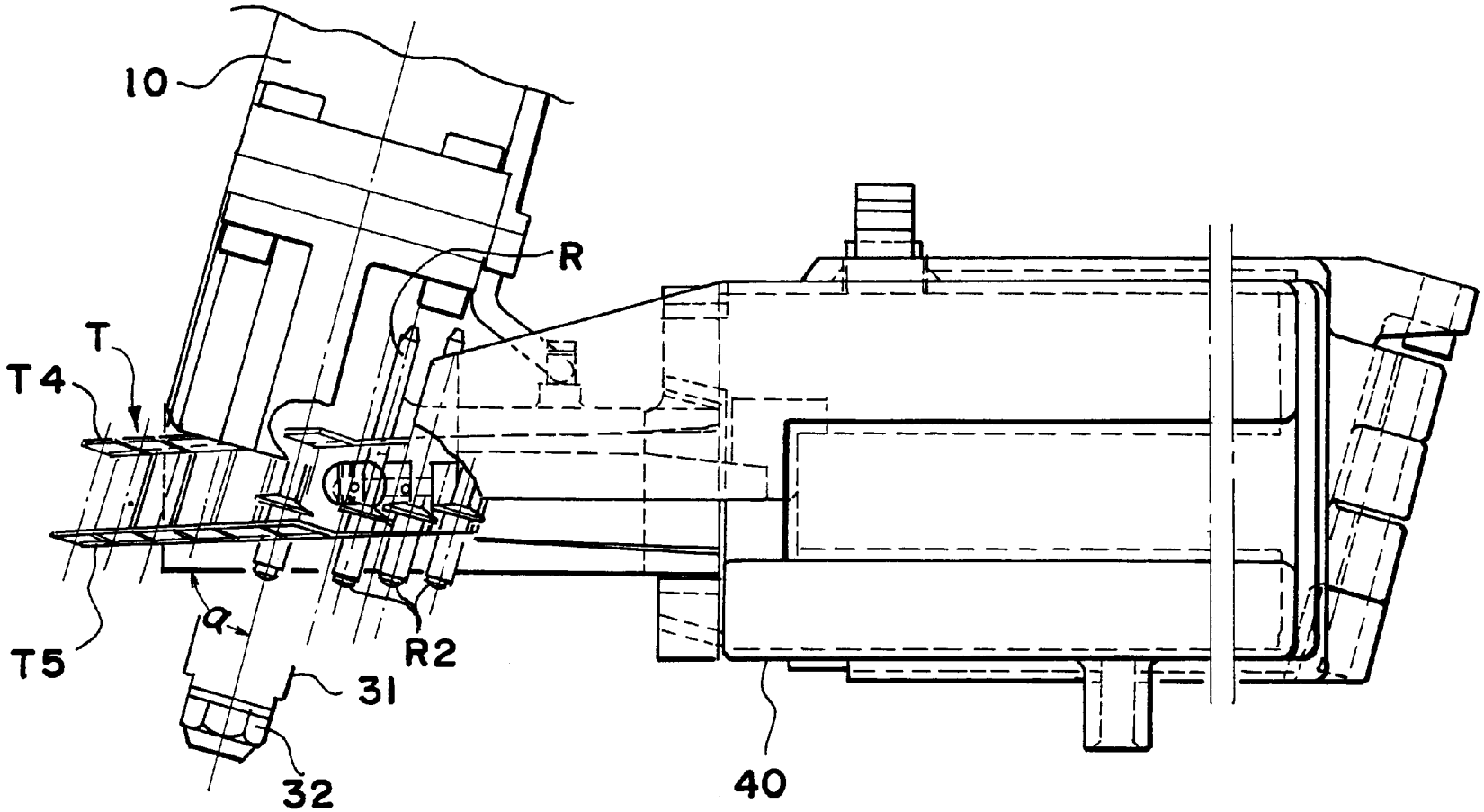
FIG. 5 is a side view showing a state in which the blind rivet holder according to the present invention is used in combination with the continuous riveter.

To use of the blind rivet holder T according to the present invention, the elongated blind rivet holder T of a predetermined length as shown in FIG. 1 is wound, and installed in the accommodation case 40 shown in FIG. 5 in the wound state with its outer leading end extended to the end of the U-shaped linear feed section of the guide plate.

In this case, although not shown in the drawings, the cylinder 31 of the continuous riveter is protruded downwardly so that it passes through a space of the bent section 43*b* (shown in FIG. 3) where the blind rivet holder T has not be fed yet. FIGS. 3 and 5 show an intermediate state during the consecutive caulking operation, and therefore the blind rivet holder has been already reached to the bent section 43*b*.

Figure 6:
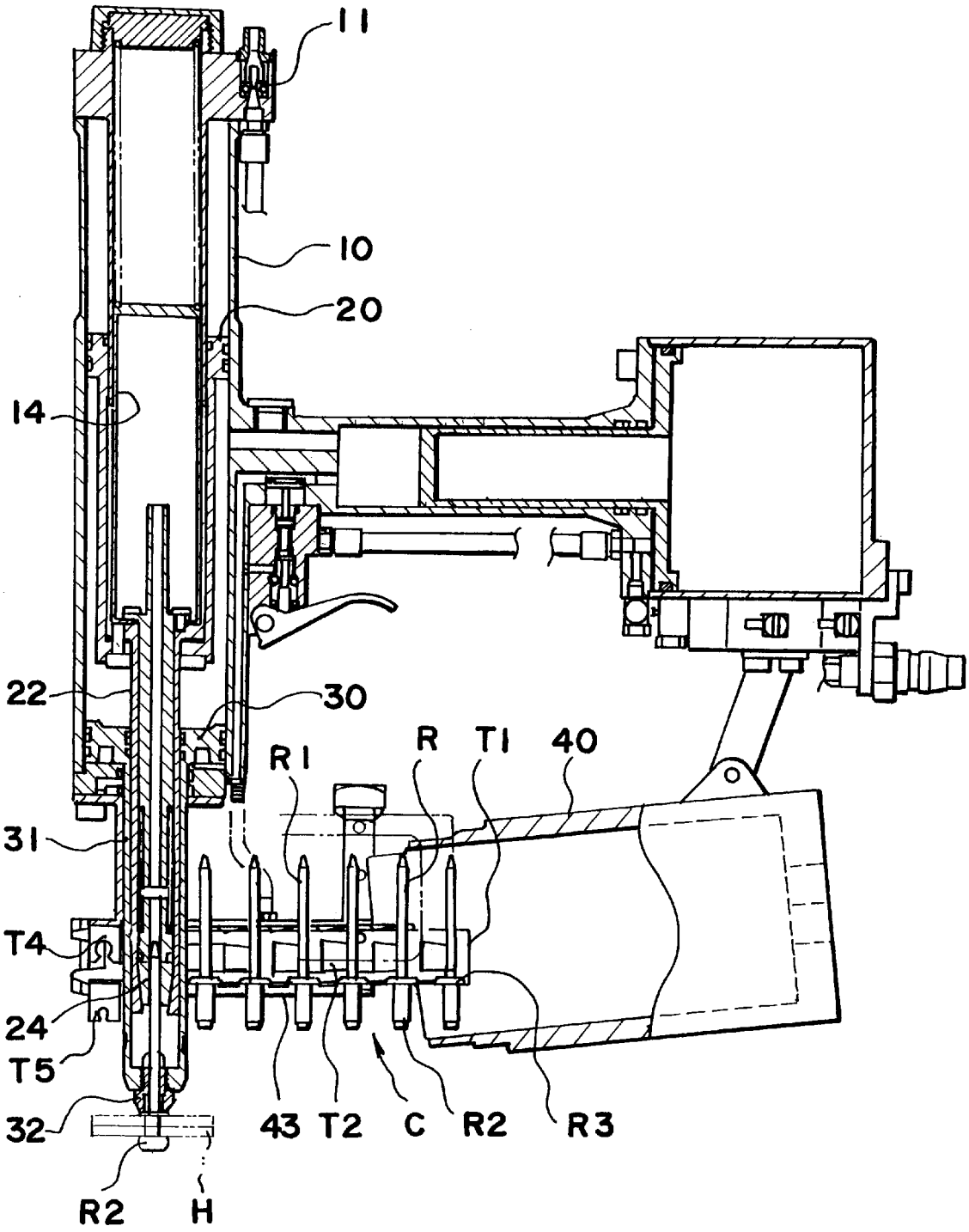
FIG. 6 is a cross-sectional view showing a state in which a blind rivet holder supporting a rivet perpendicularly with respect to a longitudinal direction of an elongated member is used in combination with a continuous riveter.
Figure 7:
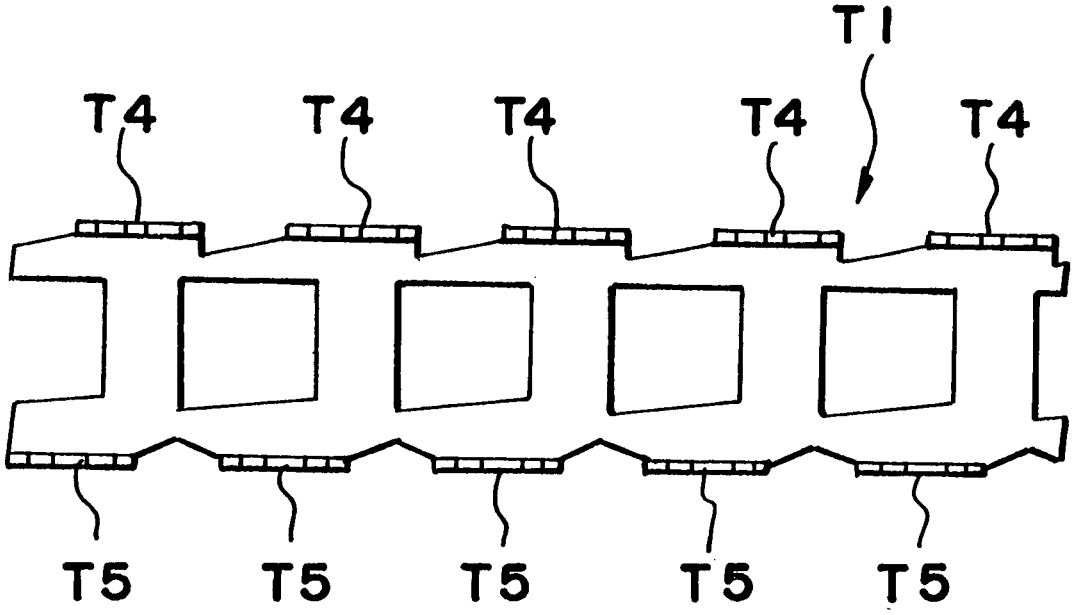
FIG. 7 is a side view showing a conventional blind rivet holder.
Figure 8:
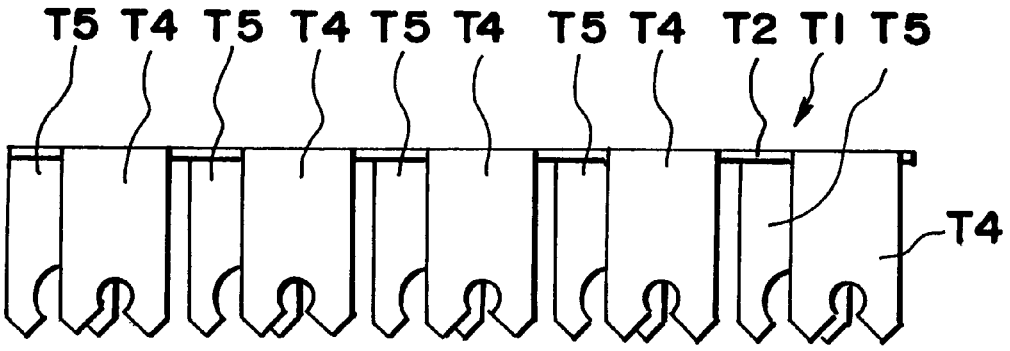
FIG. 8 is a plan view showing the conventional blind rivet holder.
Figure 9:
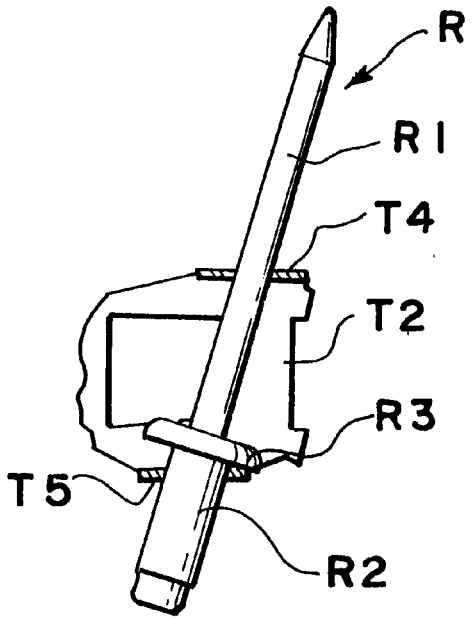
FIG. 9 is an explanatory view showing a state in which a rivet is held by the conventional blind rivet holder.

Next, an operation handle (not shown, refer to the conventional continuous riveter shown in FIG. 6) of the continuous riveter is tightened to move the cylinder 31 upwardly, and released to activate the feed claw 46*a* of the tape air cylinder 42 shown in FIG. 3 to feed the blind rivet holder T at an amount corresponding to one rivet R. Therefore, the leading end portion of the blind rivet holder T supporting the one rivet R is fed out to the bent section 43*b* while being bent at the angle β with the aid of the recessed groove T21. Concurrently, the cylinder 31 is moved downwardly while folding the upper and lower tabs T4 and T5 downwardly so that the rivet R is inserted into the hole of the nose piece 32 and held by the jaw 24. Thus, the rivet R is disengaged from the first and second through hole s T41 and T51.

A state in which the upper and lower tabs T4 and T5 are folded is the same as that shown in connection with the conventional blind rivet holder in FIG. 6.

In this state, the rod portion R2 and head portion R3 of the rivet main body of the rivet R are protruded from the nose piece 32. Therefore, if the rod portion R2 is inserted into the holes of the conventional metal plates H and the operation handle is tightened, then the rod R1 held by the Jaw 24 is moved upwardly and the rod portion R2 is deformed to perform the caulking on the metal plates H as shown in FIG. 6. The rod R1 is cutoff and collected, and then the nose piece 32 is moved upwardly along with the cylinder 31. Further, if the operation lever is released, the feed claw 46*a* feeds the blind rivet holder T at an amount corresponding to one rivet R and the cylinder 31 is moved downwardly while folding the upper and lower tabs T4 and T5 downwardly, and holds the rivet R, thereby establishing a ready state for a next caulking.

FIGS. 3 and 5 show a state in which the upper and lower tabs T4 and T5 have been returned to their original positions from their folded states after the rivet R has been used for caulking.

As shown in FIG. 3, the blind rivet holder T according to the present invention is bent at a position between the upper and lower tabs T4, T5 of the bent portion 43*b* supporting the rivet R being subjected to the caulking and immediately anterior tabs T4, T5 to define a distance L at the tab leading ends. Therefore, even if smaller slits T3 are formed between the tabs to secure only a small pitch between the adjacent rivets R, the tabs supporting a rivet R to be subjected to a next caulking do not hinder the cylinder 31 from moving downwardly.

As described above, the present invention provides the following advantages:

1) Since it is possible to set a distance (a pitch) between adjacent rivets to be smaller in comparison to the prior art, a larger number of rivets can be installed at one time in the accommodation case in comparison to the prior art.

2) Since the length of the U-shaped elongated member holding the rivets can be decreased, it is advantageous in cost and material saving property.

What is claimed is:

1. A blind rivet holder comprising:

a U-shaped elongated member having upper and lower tabs which are continuously arranged at minute constant intervals with narrow slits formed at upper and lower ends of a perpendicular portion;

feeder slots, formed in the perpendicular portion, for feeding the elongated member in a specified direction;

a first through hole, formed in each of the upper tabs, for holding a rod of a blind rivet passed therethrough; and a second through hole, formed in each of the lower tabs, for holding a rod portion of a rivet main body passed therethrough so that a head of the rivet main body of the blind rivet is retained on an inner side of the lower tab;

wherein the upper and lower tabs are offset in position from each other horizontally in a longitudinal direction of the perpendicular portion;

wherein the first and second through hole s are inclined, respectively, at an angle to conform with the outer periphery of the rod and rod portion of the blind rivet passed obliquely; and wherein an inclined, recessed groove is provided on an inner side of the perpendicular portion so as to connect the slit between the adjacent upper tabs to the slits between the adjacent lower tabs.

2. A blind rivet holder according to claim 1, wherein the elongated member is relatively rigid but bendable at locations where the recessed groove is provided.

3. A blind rivet holder according to claim 1, wherein a first slit between adjacent upper tabs, a second slit between adjacent lower tabs, and a recessed groove connecting the first slit to the second slit cooperatively facilitate the bending of the elongated member to increase a distance between adjacent first through hole s provided in the adjacent upper tabs and a distance between adjacent second through hole s provided in the adjacent lower tabs.

* * * * *